United States Patent [19]

Scribner

[11] 4,051,987

[45] Oct. 4, 1977

[54] HIGH SPEED STOCK FEEDER FOR PUNCH PRESSES AND THE LIKE

[76] Inventor: Albert W. Scribner, 6 Country Club Road, Darien, Conn. 06820

[21] Appl. No.: 679,438

[22] Filed: Apr. 22, 1976

[51] Int. Cl.[2] ..... B65H 17/36; B65H 17/44

[52] U.S. Cl. ..... 226/115; 226/146; 226/151; 226/159; 226/162; 251/230

[58] Field of Search ..... 226/162, 115, 112, 165, 226/144, 146, 151, 150, 159; 251/230; 271/268, 108, 85; 214/1 BB

[56] References Cited

U.S. PATENT DOCUMENTS

| | | | |
|---|---|---|---|
| 3,136,335 | 6/1964 | Beech et al. | 251/230 X |
| 3,753,522 | 8/1973 | Voges | 226/162 X |
| 3,847,320 | 11/1974 | Scribner | 226/115 |

*Primary Examiner*—Bruce H. Stoner, Jr.

[57] ABSTRACT

A high speed dual-slide type pneumatic feeder for intermittently advancing strip stock into the work station of a punch press or the like characterized by a novel asynchronous type fluid control system which includes a rotary control valve that is intermittently stepped to a plurality of predetermined operative angular positions by means of a ratchet mechanism that is adapted to be operated in response to the ram motion of the punch press. The feeder is also characterized by an improved, compact, flexible and more efficient structural arrangement, and by a novel stock grip releasing system and valving arrangement therefor that automatically causes the stock to be released immediately after completion of each feed stroke of the feeder.

30 Claims, 19 Drawing Figures

Fig. 5
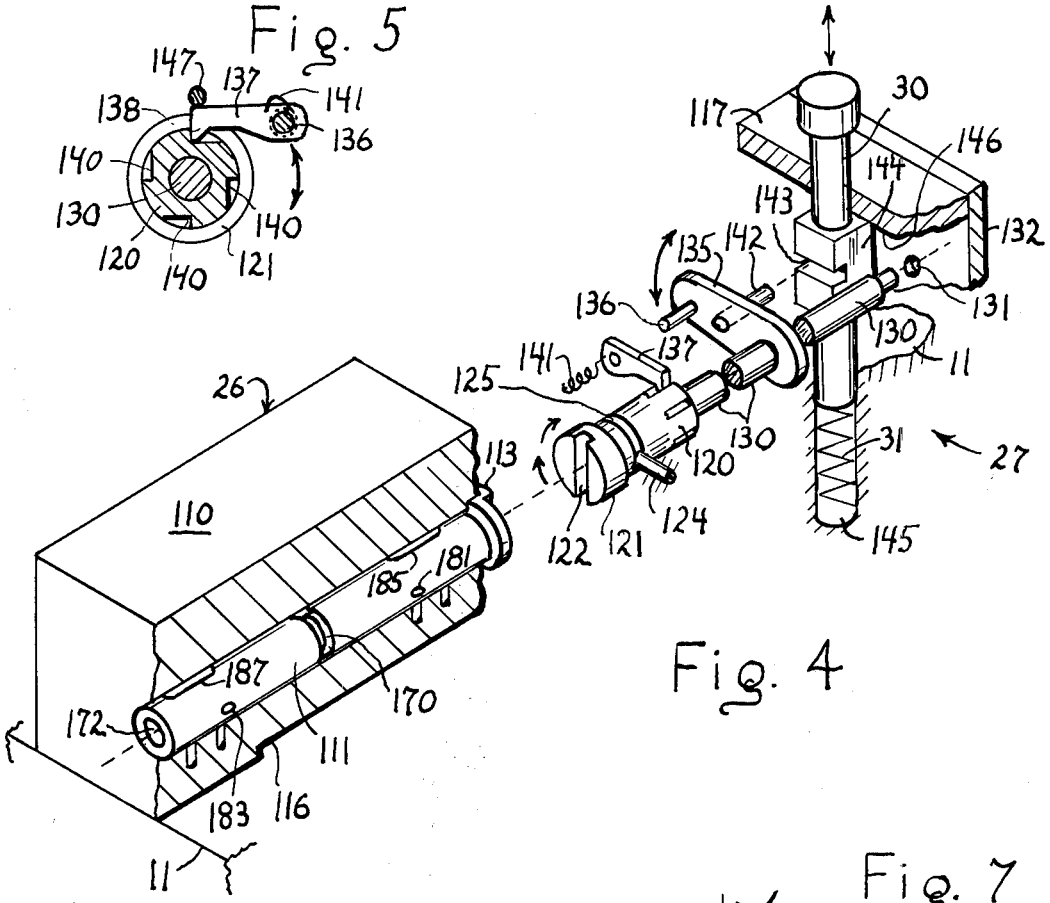
Fig. 4
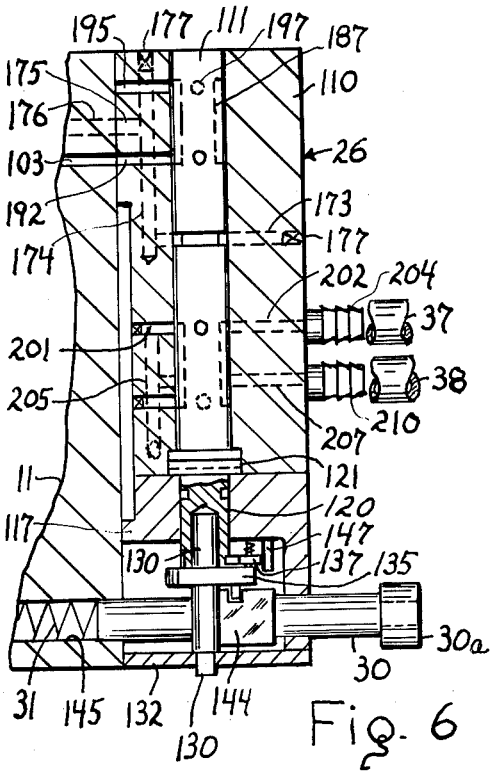
Fig. 6
Fig. 7
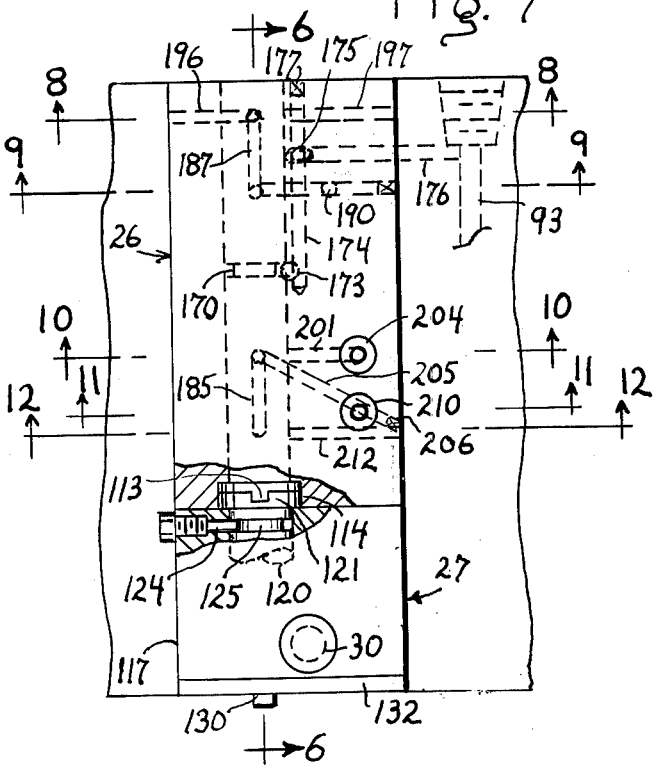

Fig. 8
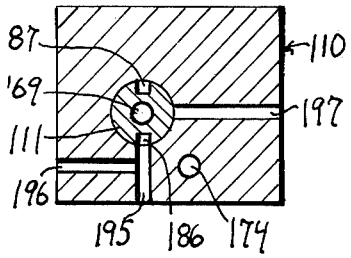
Fig. 9
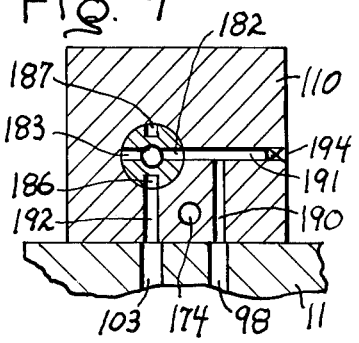
Fig. 10
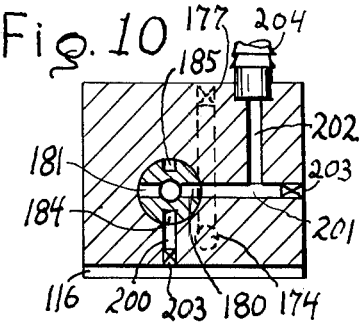
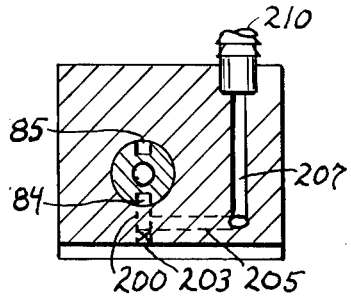
Fig. 11
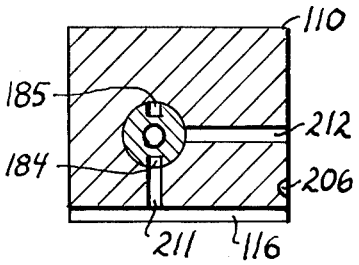
Fig. 12
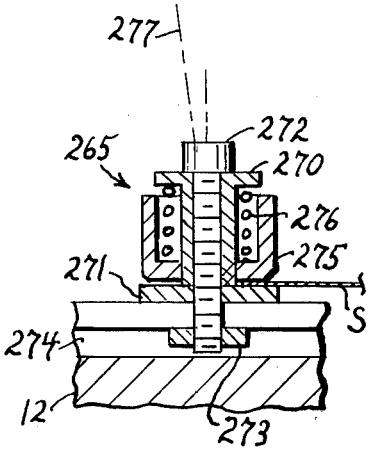
Fig. 13
Fig. 14
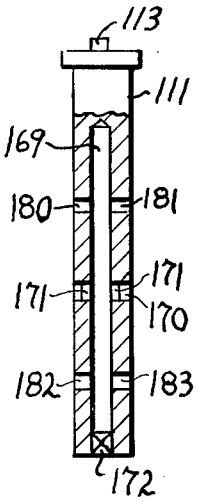
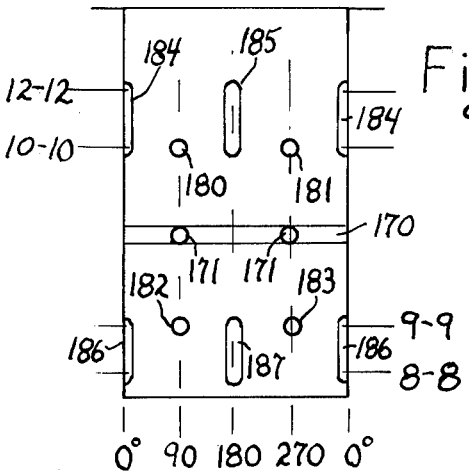
Fig. 16
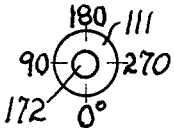
Fig. 15

HIGH SPEED STOCK FEEDER FOR PUNCH PRESSES AND THE LIKE

BACKGROUND OF THE INVENTION

In dual slide high speed pneumatic feeders the valving there for and the valve actuation means have proved to be one of the most critical areas of such systems. The duplex rotary valve stock feeder illustrated in my prior U.S. Pat. No. 3,847,320 was found to be most effective in operating at very high cyclic rates; however the driving of this rotary type valve, through interfacing of the feeder with the associated punch press, presented some practical drawbacks. Here the rotary valve was required to continuously rotate in synchronism with the rotation of the main crank shaft of the punch press and this in turn necessitated a rather elaborate and relatively expensive interconnecting gear drive between said press crank shaft and the rotary valve. While such expensive mechanical interfacing apparatus and extensive set up time might be justified for long production runs for example those lasting several weeks, such would not be justified for a high speed but short production run that might last for only a few hours or a day or two.

Further as operative press speeds increase it is imperative that air consumption per cycle of the feeder be minimized, and that the structural arrangement for the feeder be made as compact and flexible as possible.

Finally in that piloted dies are often used in high speed stamping operations it has become apparent that a more reliable and efficient arrangement must be provided in the feeder to automatically release the feed grip on the stock immediately after the completion of each feed stroke of the feeder.

SUMMARY OF THE INVENTION

The objects of this invention are to overcome the above-noted drawbacks present in the prior art high speed pneumatic feeders such as those illustrated in said U.S. Pat. No. 3,847,320 and also in U.S. Pat. No. 2,406,508. The present duplex pneumatic feeder is provided with a special type of rotary valve and intermittent drive means therefor; which feeder requires no special interfacing with the punch press and which may be quickly and easily set up in a manner corresponding to that for standard type single slide pneumatic feeders which are currently commercially available in the forms generally illustrated in U.S. Pat. No. 3,038,645. The structural arrangement of the instant feeder has been made more compact and efficient as compared to that illustrated in said prior high speed feeder patents. Here the feeder frame is unitized, the rotary valve and valve actuator are constructed and arranged in modular form, and the two feed slides are arranged so that their long dimensions are substantially parallel to and laterally adjustable with respect to the longitudinal axis of the feeder thus preventing the overall width of the feeder from being excessively large. Also the present feeder employs a pull rather than a push system for feed slide actuation and only a single air pressure level is needed to operate the unit. Finally in order to provide for a more efficient stock gripping control the gripper fluid motor on each feed slide is controlled by two separate three-way valving means, namely a primary rotary valve means and a second or auxiliary valve means; only the former being operative to initiate the supply of pressure fluid to said gripper motor while the latter is operative only to exhaust pressure fluid from said gripper motor. To this end a sensing plunger is provided on each feed slide and detects the approach of the completion of the feed stroke of the feed slide and serves through a mechanical time delay coupling to operate said auxiliary valve means at a time just after completion of said feed stroke. This action effectively releases the stock for slight positional adjustment by any pilot pins present in the punch press die being used.

Other objects of the invention will become apparent as the disclosure progresses.

In the drawings:

FIG. 4 is an exploded perspective view illustrating the construction of the rotary valve and the ratchet drive mechanism for said rotary valve.

FIG. 5 is an enlarged cross sectional view showing the ratchet toothed drive shaft and the associated cooperating pawl.

FIG. 6 is a sectional view taking along section line 6—6 of FIG. 7 and illustrates the assembled arrangement of the parts shown in FIG. 4.

FIG. 7 is a plan view showing the construction and arrangement of the valve and the stepper modules.

FIGS. 8–12 are sectional views respectively taken along section lines 8—8, 9—9, 10—10, 11—11 and 12—12 of FIG. 7.

FIG. 13 is an elevational view taken in cross section and shows the construction of the stock guide and braking means.

FIG. 14 is a side view in partial axial section and illustrates the construction of the tubular valve core.

FIG. 15 is an end view of the valve core shown in FIG. 14.

FIG. 16 is a diagrammatic view illustrating the development of the outer cylindrical surfaces of the said valve core.

Figure 1:
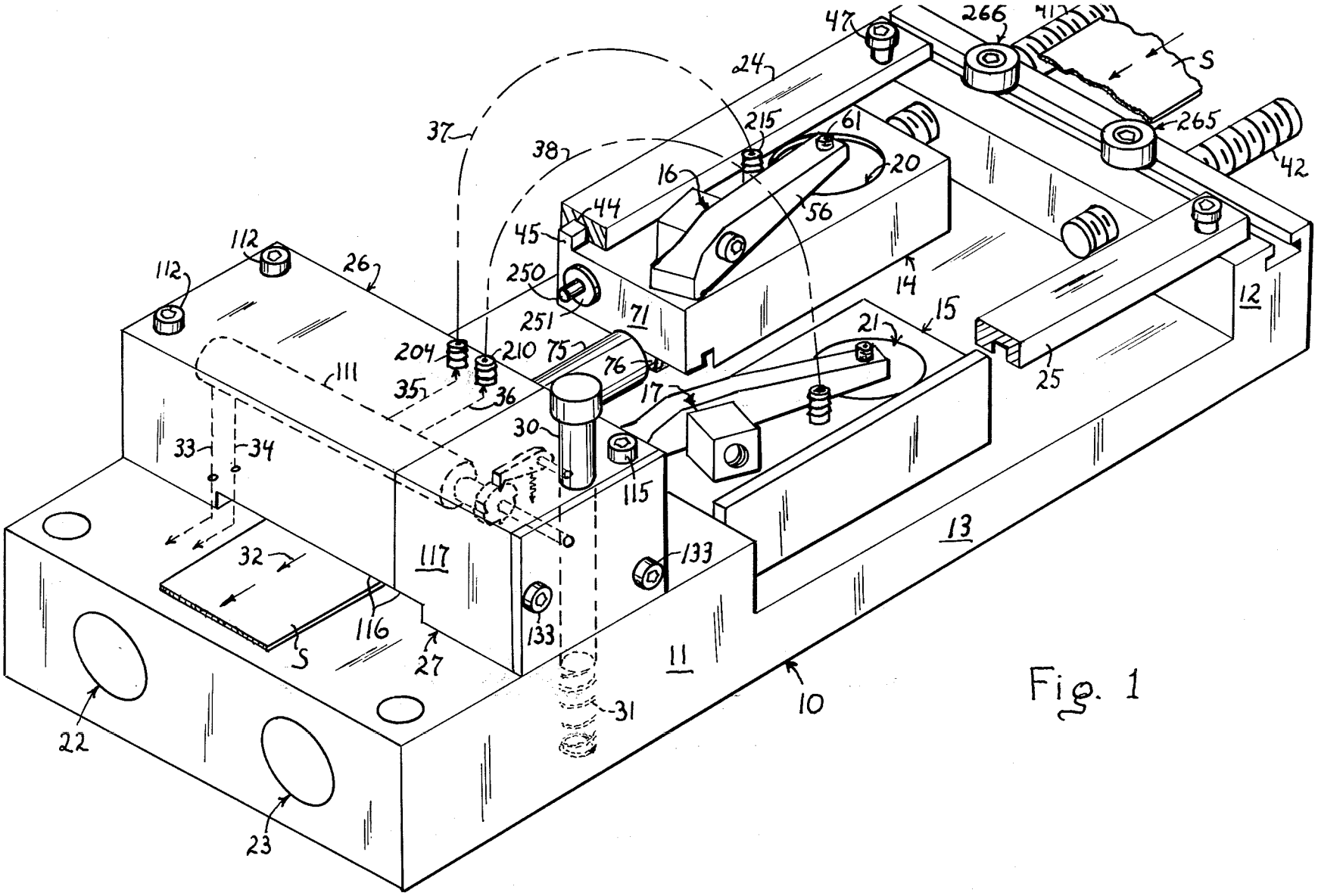
FIG. 1 is a perspective view illustrating the general construction and operation of the present duplex feeder.

A general description of the invention will be made first in connection with the overall perspective view of FIG. 1. The present duplex feeder comprises a generally rectangular one-piece U-shaped main frame 10 that includes a main body portion 11, an end block portion 12, and an intermediate platelike portion 13 that integrally interconnects the lower regions of said frame portions 11 and 12. Slidably mounted on the upper flat surfaces of said plate-like frame portion 13 is a pair of alternately acting feed slides 14 and 15 that carry stock gripping means 16 and 17 respectively. The stock gripping means 16 and 17 are actuated from stock release to stock gripping positions by means of single acting fluid motors 20 and 21 respectively disposed on said slides 14 and 15. A pair of double acting main fluid motors 22 and 23 are provided in the main body portion 11 of the frame for reciprocally actuating said feed slides; the latter being respectively guided for rectilinear movement along rails 24 and 25 that extend between and are adjustably secured to the said main body and end block portions 11 and 12 of the main frame. The operation of the single acting gripper fluid motors 20 and 21 and the main double acting fluid motors 22 and 23 is controlled by a rotary valve means or module 26 that includes a rotary valve member that is sequentially stepped to and stopped at predetermined successive angular positions thereof by means of a stepper mechanism or module 27. The stepper module 27 comprises a ratchet mechanism which is actuated by a vertically reciprocable control plunger 30 that is yieldably biased to a normal upper position shown in FIG. 1 by means of a compression spring 31. The cooperating valve and stepper modules are mutually disposed in cooperating end to end relation and extend transversely on the main body portion 11 so as to bridge the stock being fed in the feed direction indicated by arrow 32.

The rotary valve module 26 is capable of controlling the flow of pressure fluid to and from (a) the double acting main fluid motors 22 and 23 through lines diagrammatically indicated at 33 and 34 respectively, and (b) the single acting fluid motors 20 and 21 through lines diagrammatically indicated at 35 and 36 respectively; the latter being effectively associated with flexible plastic tubing lines 37 and 38 that extend from the valve module 26 to the movable feed slides 14 and 15 respectively. The tubing lines 37, 38 are connected to the feed slides so as to permit pressure fluid to be supplied and exhausted from the respective gripper motors 20 and 21 as will be more fully described below.

The rotary valve module 26 is arranged so that in a first operative position of the rotary valve member the feeder operates through a first cycle of operation wherein (a) the stock gripping means 16 on feed slide 14 grips the stock while the slide 14 is moved through a feed stroke to thereby advance the stock S through a first feed increment, and (b) the stock gripping means 17 on slide 15 is released while the slide 15 is moved in a non-feed direction until it strikes the inner end of the associated one of the two conventional type feed stroke adjusting screws 41, 42 that are threadedly carried by the end block portion 12 of the main frame. To initiate the next feed cycle the plunger 30 is depressed and thereafter allowed to move upwardly under the action of compression spring 31 so that during said upward movement the ratchet mechanism will yieldably rotatably index the rotary valve member to, and stop the same at, its next predetermined discreet rotary position wherein the feed slide 15 will now be caused to move through a feed stroke to thereby advance the stock S through an equal second feed increment while the feed slide 14 is caused to move through a non-feed stroke. As will be seen then the successive operation of the control plunger 30, as by means of the ram of a punch press, will cause said feed slides to alternately partake of a rapid series of feed strokes which are capable of intermittently advancing the stock into the work station of a punch press or the like. The said guide rails 24, 25 for the feed slides are laterally adjustable on the main frame and hence the lateral distance between the parallel paths of movement of the feed slides may be correspondingly varied to accommodate stock of varying widths; the feed slides 14 and 15 here being laterally movable relative to their respectively associated main fluid motors by a slotted connection therebetween as is generally shown in FIG. 1 for a slide 14 and as will be more specifically described below. For simplicity of illustration the rotary valve and the ratchet mechanism are shown in very diagrammatic fashion in FIG. 1; however reference to the other drawing figures will be made to describe the actual construction and arrangement of these valve and ratchet devices.

Figure 2:
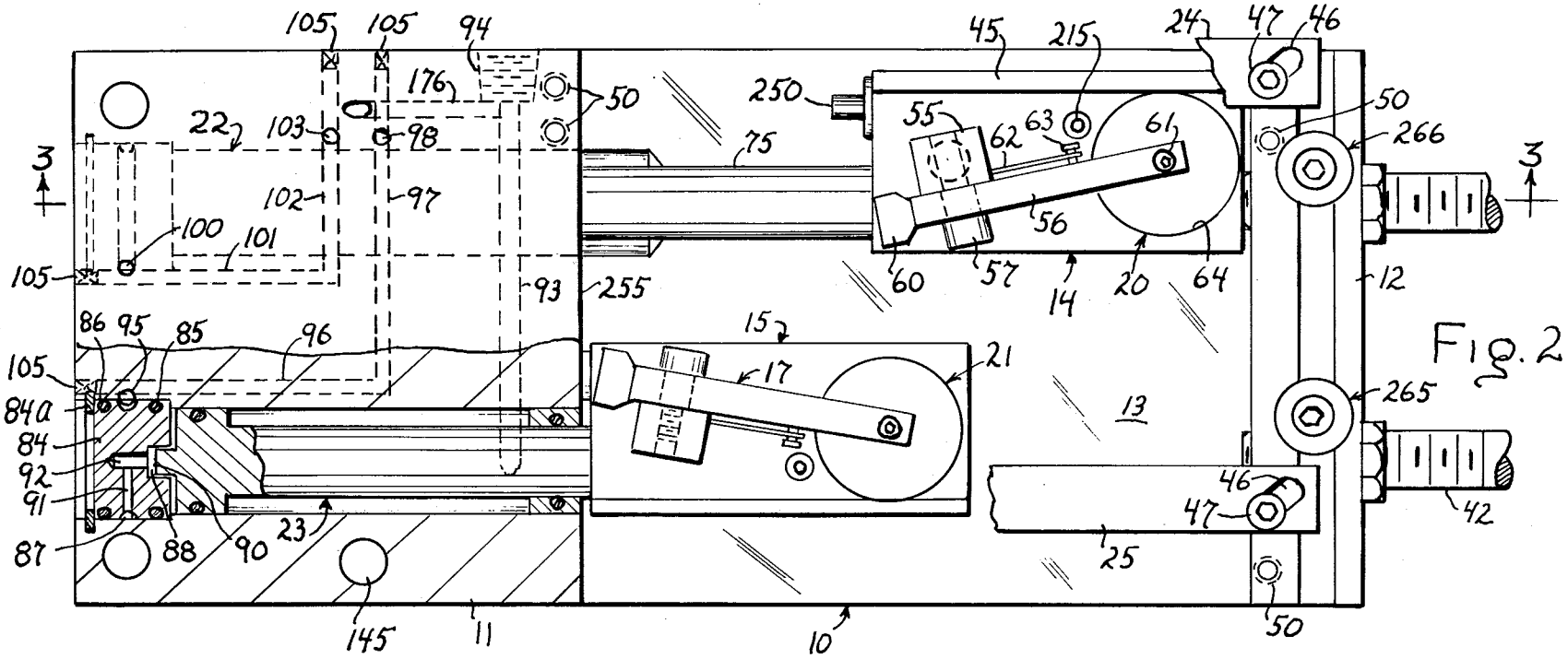
FIG. 2 is a plan view illustrating the main frame and feed slide arrangement for the instant feeder.
Figure 3:
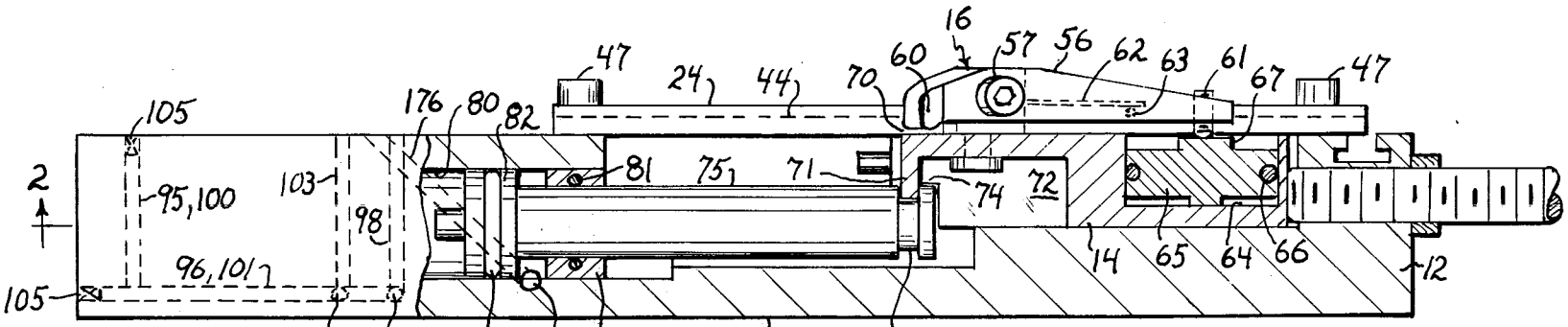
FIG. 3 is an elevational view taken in partial section along section line 3—3 of FIG. 2.

A more detailed description of the structure and operation of the present feeder will now be made with initial reference to FIGS. 2 and 3 which illustrate the feed slides and the associated support and actuating means thereof. In that the two slide units are similar a discussion of either one of the slides and said associated support and actuating means will suffice here. Feed slide 14 is generally rectangular in shape and has its long axis disposed substantially parallel to the longitudinal axis of the main frame 10 of the feeder. The feed slide 14 is guided for rectilinear reciprocating movement on the flat upper surface of the said plate-like frame portion 13 by means of the guide rail 24 that is formed with a longitudinal groove 44, FIGS. 1 and 3, which extends along the bottom thereof and which is adapted to slidably receive the upwardly extending flange 45 formed on the upper side portion of the feed slide 14. Each end of the rail 24 is formed with 45 degree oriented slots 46 through which extend screws 47 that serve to secure the respective rail ends to the main body and end block portions 11 and 12 of the main frame. Said frame portions 11 and 12 are each provided with a corresponding pair of threaded holes such as 50 at each end of said rail, which holes are selectively adapted to receive said screws 47 so that coarse lateral adjustment of the rail on the main frame may be obtained by using either of the holes while fine lateral adjustment thereof may be obtained by varying the position of the rail slots 46 relative to said screws 47; the rails at all times being disposed parallel to the longitudinal axis of the feeder so as to insure that the rectilinear reciprocating movement of slide 14 is also parallel to said longitudinal feeder axis. This lateral adjustment of the operative position of the rails 24, 25 will thus allow the path of movement of the slides to be laterally shifted with respect to the feeder axis.

The stock gripping means 16 comprises a vertically disposed post 55 that is secured to the top of slide 14, a stock gripping lever 56 being pivotally mounted on said post by any suitable means such as a shoulder screw 57. The forward end of lever 56 is formed with stock engaging nose 60 while the rearward end thereof is provided with adjustable screw 61 the lower end of which is adapted to be engaged and displaced upwardly by the said single acting fluid motor 20. The grip lever 56 is adapted to be continuously biased in a clockwise direction, as seen in FIG. 3, by means of a horizontally disposed wire leaf spring 62, one end of which is anchored in a suitable recess formed in said post 55 while the other end engages and yieldably presses downwardly against the upper edge of a laterally extending pin 63 carried by grip lever 56. Said fluid motor 20 comprises a cylinder 64 formed in said slide 14 and in which is slidably disposed a piston 65 having any suitable conventional sliding seal, such as O-ring 66, at its periphery and having a short upstanding piston rod 67 the upper end of which engages the lower end of said screw 61; the latter being adjustable to determine the maximum desired stock thickness gap 70 between the said lever nose 60 and the adjacent portion of the top surface of the feed slide 14. The forward portion of the feed slide is recessed at the bottom thereof so as to provide a front wall 71, FIG. 3, and adjacent side walls 72; said side walls being notched as at 74 and the lower edge of said front wall being slightly higher than the lower adjacent edges of the said side walls. The slide 14 is coupled to the piston rod 75 of said double acting main fluid motor 22; the outer end of said piston rod being formed with an annular groove 76 which is adapted to receive the said lower edge of said front wall 71 of the feed slide 14. As will be apparent this coupling will permit the said main fluid motor 22 to actuate slide 14 in feed and non-feed directions but will also permit slide 14 to be laterally adjusted with respect to the axis of said piston rod 75 by the above described shifting of the operative lateral position of rail 24 whereby the longitudinal path of reciprocating movement of said feed slide 14 may be laterally shifted towards or away from the longitudinal axis of the feeder so as to accommodate different stock widths.

The piston rod 75 extends through a collar 77 that is press fitted into the end of a main cylinder bore 80 formed in the main body portion 11; said collar being provided with any suitable internal seal, such as O-ring 81, that slidably engages the outer surfaces of piston rod 75. The forward end of the piston rod is formed with a piston 82 that is provided with any suitable external sliding seal, such as O-ring 83, that engages the walls of the said main cylinder 80. The forward ends of both main cylinders are closed by similar cylindrical plugs; the plug for fluid motor 23 being indicated at 84, FIG. 2, and being retained in its associated cylinder end by any suitable conventional type of internal retainer ring 84*a*. The plug 84 is provided with two axially spaced external O-ring seals 85 and 86 and is formed with an external annular groove 87 therebetween. The inner face of plug 84 is formed with an axial cylindrical recess 88 that is adapted to receive the slightly smaller diameter projection 90 that is axially formed on the forward end of the associated main piston of the fluid motor 23. The projection 90 and the recess 88 cooperatively provide a cushioning effect for quickly and smoothly decelerating the motion of feed slide 15 at the end of a feed stroke of fluid motor 23 in a manner that is well understood in the art. The plug recess 88 communicates with the annular external plug groove 87 through an axial passage 92 and a communicating radial passage 91 formed in said plug 84.

The rod ends of both main fluid motors 22 and 23 are adapted to be continuously supplied with pressure fluid through a common supply line 93 and an associated threaded fluid inlet opening 94. Pressure fluid is conducted to and from the head end of the fluid motor 23 through communicating lines 95, 96, 97 and 98 formed in said main body portion 11 of said frame 10, while pressure fluid is conducted to and from the head end of the main fluid motor 22 through corresponding communicating lines 100, 101, 102 and 103 also formed in the main body portion 11 of said frame. The lines 95 and 100 respectively communicate with the said external grooves, such as 87, formed in the said cylindrical plugs such as 84; while the upper ends of lines 98 and 103 are closely spaced and emerge through the top surface of said main body portion 11 as is best seen in FIGS. 2 and 3. The outer ends of lines 95 and 100, 96 and 101, and 97 and 102 are respectively plugged as is indicated at 105. As will be understood when pressure fluid is introduced into the upper end of said line 103 the main fluid motor 22 will move slide 14 in a non-feed direction or to the right as seen in FIGS. 2 and 3; and when pressure is exhausted from the upper end of this line 103 the continuously acting fluid pressure acting at the rod end of said fluid motor 22 will cause said feed slide 14 to be moved in the feed direction 32. In similar fashion the main fluid motor 23 will move the feed slide 15 in non-feed and feed directions when pressure fluid is supplied and exhausted respectively to and from the said upper end of said line 98.

The valve module 26, FIG. 1, and the valve stepper module 27 will now be described in connection with FIGS. 4–7. The valve module 26 comprises a valve block 110 which is secured to the top of the main body portion 11 by any suitable means such as screws 112, FIG. 1, and which has rotatably mounted therein a valve core or member 111. The right hand end, as seen in FIG. 4, of core 111 has a cylindrical flange formed thereon, the exposed face of the latter being formed with diametrically extending key-like projection 113; said flange being disposed in an enlarged recess, 114 FIG. 7, formed in the adjacent end of the valve block 110. The cooperating air lines and valving ports in the valve block and valve core will be more fully described below in connection with FIGS. 8–12. The valve core 111 is adapted to be rotatably indexed through 90 degree steps so as to stop at succesive predetermined discreet operative rotative positions thereof by means of the stepper module 27; the latter comprising a main block 117 that is also secured by any suitable means such as one or more screws 115, FIG. 1, to the top of said main body portion 11. The two modules are disposed transversely on the main frame and in mutually coextensive end to end relation with the adjacent inner bottom portions thereof being slightly recessed, as shown at 116 of FIG. 1, so as to afford a gap between said modules and the upper surfaces of said main body portion 11 through which the stock being fed may pass.

The stepper module 27 comprises an output drive shaft 120, FIG. 6, which is rotatably mounted in said main stepper block 117, the inner or left end as seen in FIG. 4 of said shaft being formed with a flange 121 that has a diametrically extending groove 122 formed in the inner face thereof. As illustrated in FIGS. 6 and 7 the drive shaft flange 121 extends coaxially into the said recess 114 in the adjacent end of the valve block so that said key projection 113 on the valve core will be received in said groove 122 of the drive shaft 120 whereby shaft 120 may rotatably drive said valve core 111. The inner end of a retaining pin 124, FIG. 7, engages an annular groove 125 formed in said drive shaft so as to axially retain the latter in the stepper main block 117. The inner end of a pivot shaft 130, FIG. 6, is rotatably mounted in an axial recess formed in the adjacent outer end of the main drive shaft 120 as is best seen in FIGS. 5 and 6, while the reduced outer end thereof is rotatably supported in a suitable hole 131, FIG. 4, formed in a support plate 132 that is secured to the stepper block 117 by any suitable means such as screws 133, FIG. 1.

Reference will now be made primarily to the exploded perspective view of FIG. 4 which best illustrates the construction and operation of the ratchet mechanism of the stepper module 27; however reference may be made to FIGS. 6 and 7 to view the various parts in their respective operative assembled conditions. Some of the various support means shown in FIGS. 6 and 7 have been eliminated from FIG. 4 for the purpose of clarity of illustration. Rotatably fixed to the intermediate portion of said pivot shaft 130 is a crank arm 135 to the free end of which is fixed a pin 136 on which is pivotally mounted a ratched pawl 137. The tooth 138, FIG. 5, formed at the free end of said pawl, is adapted to cooperate with four equally spaced ratchet teeth 140 formed about the adjacent portion of the periphery of said output drive shaft 120; the pawl 137 being continuously biased in a clockwise direction, as seen in FIG. 4, by means of a suitable spring 141. The crank arm 135 is actuated by means of a pin 142 which is secured thereto and which extends into a horizontally extending groove 143 formed in the adjacent rectangularly cross sectioned intermediate portion 144 of the control plunger 330; the latter extending upwardly through a suitable aperture formed in the stepper block 117 and downwardly into a vertically disposed hole 145, FIGS. 2, 4 and 6, formed in the said main body portion 11 of the frame 10. A cap 30*a*, FIG. 6, is secured by any suitable means to the top of plunger 30. The said spring 31 is disposed between the bottom of plunger 30 and the bottom of said hole 145 so as to continuously urge said plunger upwardly to a normal position determined by engagement of the upper edges of the rectangular cross sectioned portion 144 thereof with the lower surface 146 of the top wall of said stepper body 117 as is best seen in FIG. 4.

In operation when the control plunger 30 is depressed the crank arm 135 will be thereby swung in a counterclockwise direction as seen in FIG. 4 so that the ratchet tooth 137 will ride idly over 90 degrees of the periphery of drive shaft 120 and drop behind the next ratchet tooth 140. When the control plunger is subsequently allowed to be moved upwardly under the action of said compression spring 31 the crank arm 135 will now be yieldably driven in a clockwise direction, as seen in FIG. 4, so that the pawl 137 will rotatably index said shaft 120, and thus also the valve core 111 coupled thereto, through 90 degrees of rotation and then stop the same so that said valve core is thereby positioned at its next predetermined operative rotary position. Inertial overtravel of the drive shaft 120 and the valve core 111 is prevented by means of a pin 147, FIGS. 5 and 6, that is secured to the stepper block 117 in a position such as to overlie the free end of pawl 137 when the latter, after bodily swinging in a counterclockwise direction as seen in FIG. 5, reaches its normal stationary position illustrated in FIG. 5. The prevention by pin 147 of any elevation of the free end of the said stationary pawl acts to stop any further inertial counterclockwise rotation, as seen in FIG. 5, of the drive shaft 120 and valve core 11. The stepper module 27 thus affords a means for successively indexing the valve core through successive 90 degree steps in response to the successive operation of said control plunger 30. For ease of illustration the axial plane of plunger 30 is shown in FIG. 6 as being in the section plane 6—6 of FIG. 7.

A discussion of the details of the pressure conduit lines and valving ports associated with the valve module 26 will now be made with particular reference to FIGS. 6, 7 and 8–12. The valve member or core 111 is axially drilled to form a hollow interior 169, FIG. 14, to which pressure fluid is adapted to be continuously supplied through an external annular groove 170, FIGS. 4 and 14, formed on core 111 and through holes 171 formed through the tubular core walls at the bottom of said groove 170. The outer end of the axially drilled valve core is plugged as indicated at 172 of FIG. 14. When the core 111 is assembled in the valve block 110 as indicated in FIGS. 6 and 7 pressure fluid is adapted to be supplied to said core groove 170 through communicating fluid conducting lines 173, 174 and 175, FIGS. 6 and 7, formed in said valve block 110. The line 173 intersects the bore for the valve core at a point adjacent said groove 170; while the lower end of line 175, FIG. 6, emerges from the bottom of the valve block 110 at a point which communicates with the open upper end of an angularly disposed line 176, FIGS. 2, 3 and 6 and 7, formed in said main body portion 11 of said frame; said line 176 communicating with said fluid pressure supply line 93. The outer ends of lines 173 and 174 are plugged as indicated at 177 of FIGS. 6 and 7. Thus pressure fluid is continuously supplied from said supply line 93 in the main feeder frame to the interior 169 of the valve core 111. The external cylindrical surface development of the valve core 111, as shown in FIG. 16, illustrates the said annular groove 170 and diametral holes 171. The walls of the tubular core are shown as also being formed therethrough with a pair of main cylinder fluid supply holes 182 and 183 that are disposed at 90° and 270° positions, FIGS. 15 and 16, and similar gripper cylinder fluid supply holes 180 and 181 that are also disposed in the noted 90 and 270 degree positions. A pair of main cylinder exhaust grooves 186 and 187 are formed in and extend longitudinally of the core periphery at the 0 and 180 degree positions illustrated in FIG. 16, while corresponding gripper cylinder exhaust grooves 184 and 185 are also formed and disposed at the said 0 and 180 degree positions. The said exhaust grooves extend radially only part way through the walls of tubular valve member. The section lines 8—8, 9—9, 10—10 and 12—12 shown in FIG. 16 correspond respectively to the section lines 8—8, 9—9, 10—10 and 12—12 illustrated in FIG. 7.

The said various holes and grooves formed in the valve core 111 valvingly cooperate with ports and associated lines formed in valve block 110 as will now be described. One operative rotative valve core position is depicted in FIGS. 8–12 wherein the relative positions of the cooperating holes of the valve block and valve core at the various sections noted in FIG. 7 are respectively illustrated. This one rotative position of core 111 functionally serves to initiate a feed stroke of the slide 14 and a non feed stroke of slide 15. In FIG. 9 the valve control lines for the main fluid motors are illustrated; here the valve block 110 is formed with communicating lines 190 and 191 and a vertical line 192. The inner end of line 192 registers with the said exhaust groove 186 while the outer end thereof communicates with said upper open end of said line 103 that services the main fluid motor 22. The inner end of horizontal line 191, the axis of the latter being disposed at 90 degrees with respect to the axis of said line 192, registers with the radial fluid supply hole 182 in the valve core while the outer end thereof is plugged as indicated at 194. The lower end of line 190 communicates with the upper open end of said line 98 that services the main fluid motor 23. As will be apparent from FIG. 9, the valve core hole 182 will supply pressure fluid to line 98 and the associated fluid motor 23, while pressure fluid is simultaneously exhausted from line 103 and the associated fluid motor 22 and to the valve core exhaust groove 186; thus exhausting fluid flowing through said valve core groove 186 to the valve section illustrated in FIG. 8. Here the valve block is formed with an exhaust line 195 and a communicating line 196, and with another horizontal exhaust line 197, the axis of the latter being disposed 90 degrees with respect to the axis of said line 195. As will be seen the said exhaust fluid from valve core groove 186 will exhaust to the atmosphere through valve block line 195, which registers with said groove 186, and through line 196.

Simultaneously with the above noted valve control of the main fluid motors 22 and 23 the gripper motors on the feed slides will be similarly controlled as will now be described with particular reference to FIGS. 10–12. Referring first to FIG. 10 the block 110 is formed with a vertical line 200 and two additional communicating lines 201 and 202; the outer ends of lines 201 and 202 being plugged, as indicated at 203, and the axes of lines 200 and 201 being disposed mutually perpendicular. The upper end of line 202 communicates with a tubular barbed fitting 204, FIGS. 2, 4 and 10, that is secured to the top of valve block 110. The radial fluid supply hole 180, FIG. 10, of the valve core 111 registers with the line 201 and thereby permits pressure fluid to flow into line 202, fitting 204 and through the said flexible plastic tubing line 37, FIGS. 2 and 6, which is connected to fitting 204 and which services the fluid gripper motor 20 on the slide 14. At the same time the inner end, FIG. 16, of exhaust groove 184 of the valve core registers with said line 200 which communicates with an angularly disposed horizontal line 205, FIGS. 6, 7 and 11, formed in the block 110; the line 205 being plugged at its outer end, as indicated at 206, FIG. 7, and communicating with a vertical line 207, FIGS. 6 and 11, that in turn communicates with a second tubular barbed fitting 210 which is also secured to the top of valve block 110. To the fitting 210 is connected the other flexible plastic tubing line 38, FIGS. 2 and 7, that services the fluid gripper motor 21 on the feed slide 15. As indicated in FIG. 11 pressure fluid may thus be exhausted from gripper motor 21 through lines 38, 207, 205, 200 and exhaust groove 184; the latter extending longitudinally of the valve core periphery to the section 12—12 of FIG. 7. As illustrated in FIG. 12 vertical and horizontal exhaust lines 211 and 212 respectively are formed in the valve block 110 at section 12—12, FIG. 7; line 211 permitting the pressure fluid from the core groove 184 and fluid motor 21 to exhaust to the surrounding atmosphere. It will thus be seen that in the one valve condition illustrated collectively by FIGS. 8–12 pressure fluid will be supplied to the gripper motor 20, FIG. 1, and such will cause the stock gripping means 16 to grip the stock while the head end of the main fluid motor 22 is exhausted so as to thereby allow the feed slide 14 to move in the feed direction 32 of FIG. 1. Simultaneously the gripper motor 21 can be exhausted so that the stock gripping means 17 will release the stock while pressure fluid is supplied to the head end of the fluid motor 23 to thereby move the feed slide 15 in an opposite non-feed direction.

When the control plunger 30 is next moved through one cycle, i.e. downwardly and upwardly, to thereby index the valve core 111 to and stop at its next 90 degree position, said valve core will then be in a position which is displaced 90 degrees counterclockwise from its position shown in FIGS. 8–12. When so indexed the various above described supply and exhaust valving control conditions for the four fluid motors will then be respectively reversed; thus here pressure fluid will be supplied to the main fluid motor 22, FIG. 1, and can be exhausted from the associated gripper motor 20 so that feed slide 14 then moves through a non-feed stroke while pressure fluid is exhausted from the main fluid motor 23 and supplied to the associated gripper motor 21 so that feed slide 15 then moves through a feed stroke. In this manner the feed slides 14 and 15 will alternately incrementally advance the stock in response to the successive cyclic actuation of the control plunger 30. If desired a suitable restriction may be effectively provided at any convenient point in the fluid conduit lines between the valve core and each of the fluid motors 22 and 23 respectively so as to afford a desired time delay between the operation of each gripper motor and its associated main fluid motor as is well understood in the art.

Figure 17:
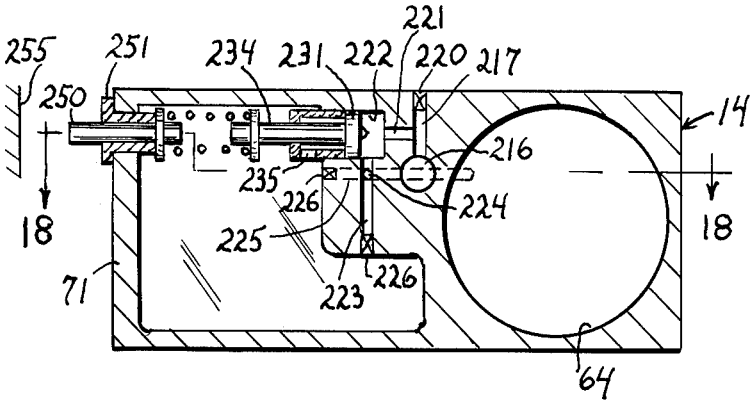
FIG. 17 is a plan view in cross section of one of the slides as taken along section line 17—17 of FIG. 18 and illustrates the construction and operation of the novel auxiliary three way valve arrangement provided on each of the feed slides.
Figure 18:
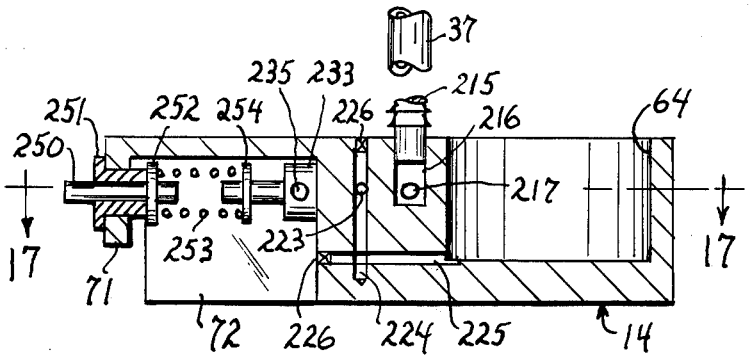
FIG. 18 is a sectional elevational view taken along section line 18—18 of FIG. 17.
Figure 19:
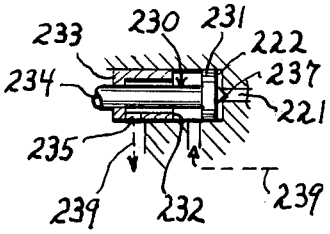
FIG. 19 is a fragmentary view of a portion of FIG. 17 and shows the valve member in its axially shifted position.

Referring now to FIGS. 2 and 17–19 the fluid connections to and conduit lines formed in said feed slides 14 and 15 will now be described. In that each slide is constructed and operates in the same manner, a specific discussion with regard to only one slide will suffice here. The flexible plastic tubing line 37 is connected to a tubular barbed fitting 215, FIGS. 1, 2 and 18, that is secured in a cylindrical recess 216 formed in the top portion of the feed slide 14; said fitting 215 communicating with a line 27 formed in said slide. The outer end of line 217 is plugged as is indicated at 220 of FIG. 17. The line 217 may communicate directly with the bottom of cylinder 64 of fluid motor 20 where no grip release of the stock is needed or desired at the end of each feed stroke to accommodate a die pilot pin positioning of the stock. However in many cases it is desired to do so, and special provision is made in connection with each of the present feed slides for a valve and valve control to produce this stock release action. Here a small light three way auxiliary valve is provided in each slide, this valve being adapted to be automatically operated by means of a slide motion sensing means and a coupling means operatively disposed between said sensing means and the auxiliary valve; the coupling means effectively defining a time delay linkage whereby the stock gripping means on each slide is automatically released a short time after the completion of each feed stroke of said slides respectively. Accordingly slide 14 is formed with a line 221 that communicates line 217 with a valve bore or cylinder 222; slide 14 also being formed with mutually communicating lines 223, 224 and 225. The inner end, FIG. 17, of line 223 communicates with the side of said valve bore 222 and the inner end of line 225 communicates with the bottom of said gripper motor cylinder 64; the outer ends of said lines 223, 224 and 225 being plugged as is indicated at 226. Coaxially disposed in valve cylinder 222 is a flanged valving member 230, FIG. 19, the left side face, as seen in FIGS. 17 and 19, of the flange 231 thereof being adapted to valvingly seat on the adjacent end face 232, FIG. 19, of a tubular support collar 233 for the valve member 230. The left end, FIG. 19, of collar 233 is provided with an axial opening through which extends the axial stem 234 of the valve member 230. The outside diameter of the valve stem 234 is considerably smaller than the inside diameter of the collar 233 so as to afford a tubular shaped fluid exhaust passage therebetween. The side wall of collar 233 is provided with an exhaust port 235. The inner or right hand end, FIG. 17, of valve member 230 is provided with a conical tip 237 that is adapted to coaxially move into and out of plugging engagement with the adjacent coaxial end of the fluid pressure conducting line 221. The valve member 230 is adapted to move axially between a first operative left hand position illustrated in FIG. 17 and a second operative right hand position illustrated in FIG. 19. In the FIG. 17 position pressure fluid can flow through lines 217, 221 and 223–225 to the cylinder 64 of gripper motor 20; said pressure fluid serving to retain valve member 230 in its said left hand position. When the valve member is axially displaced, as will be described below, to its FIG. 19 position the fluid inlet line 221 will be plugged by said tip 237 of the valve member and the lines 225, 224 and 223 will now communicate with the said exhaust port 235 in the collar 233 so that fluid pressure in said gripper cylinder 64 may then exhaust through said exhaust port 235 as indicated by arrows 239 of FIG. 19. If desired a thin annular pad of rubber or the like may be secured to the right hand face of the valve member flange 231, FIG. 17, so as to improve the said plugging of the end of line 221 when said valve member is in its said FIG. 19 position.

The valve member 230 is displaced to its FIG. 17 position by the pressure fluid being supplied to the gripper cylinder 64 preparatory for and during a feed stroke of slide 14; and is displaced to its FIG. 19 position by sensing and time delay linkage which will now be described. The slide motion sensing means includes an actuator plunger 250, FIGS. 2, 17 and 18, that is axially slidably mounted in a flanged collar 251 which is press fitted into an aperture formed in said front wall 71 of slide 14. Adjacent its inner end, FIG. 18, plunger 250 is formed with a flange 252 against the inner face of which abuts one end of time delay or coupling compression spring 253; the other end of said spring abutting a ring fastener 254 secured near the adjacent end of the said valve member 230. As may be seen in FIG.18 the left hand end of the actuator plunger 250 normally extends axially beyond the front surfaces of the collar 251 and front wall 71 of the slide 14 due to the action of said spring 253. When the slide 14 is about to complete a feed stroke the forward end of the leftwardly moving motion sensing plunger 250, as seen in FIG. 18, will engage the vertical wall or face 255, FIG. 17, of the main body portion 11 of the main frame and, with the plunger so arrested, the ensuing completion of the feed stroke causes the slide 14 to move relative to said plunger so that the time delay spring 253 is thereby compressed until the front face of the flanged collar 251 also engages said wall 255 thereby accurately arresting the feed slide in a final forward position. The operative characteristics of spring 253 are selected so that during the noted compression thereof the axial force developed therein builds up to a point where the resultant axial force exerted by said spring on the valve member 230 exceeds the oppositely acting force of the fluid pressure then acting on the right side, FIG. 17, of the valve member flange 231. When this occurs the valve member will be snapped to its FIG. 19 exhaust position by spring 253 thereby causing the stock gripper means 16 on slide 14 to be released by the exhausting of the fluid motor 20. (Here the release movement of the gripping means 16 and the associated gripper piston 65 is produced by the restoring action of said wire leaf spring 62, FIG. 2.) There is a "snap" action present in this axial movement of the valve member 230 from its FIG. 17 to FIG. 19 position in that when the spring 253 finally forces the valve member away from its FIG. 17 position the fluid pressure force tending to hold the valve member in its FIG. 17 position is greatly reduced because the effective area over which the fluid pressure in valve bore 222 then is reduced from that of the face of flange 231 to the approximate effective cross sectional area of the valve stem 234, the diameter of flange 231 being slightly less than the inside diameter of bore 222. When the valve member reaches its FIG. 19 position the said effective opposing pressure area is equal only to the effective cross sectional area of the line 221 and thus the compressed spring can readily hold the valve member in this FIG. 19 or exhausting position. Due to inertial effects of the weight of, and the said fluid pressureforce on, the valve member 230 when the latter is in its FIG. 17 position, and the relatively quick compression of the spring 253, this "snap" action of valve memer 230 will not be effective to exhaust grip cylinder 64 until a very short time after the completion of the feed stroke of slide 14. This time delay is not only desirable but necessary in that the stock gripping means 16 must retain a firm grip on the stock until the arresting of the feed stroke of slide 14 is fully completed; otherwise if the stock gripping means 16 were released too soon, i.e. before the end of the feed stroke, the stock would then inertially continue its movement to a random extent in the feed direction and thus result in an inaccurate feed increment. With the feeder operating at say 400 or 500 strokes per minute it will be appreciated that the duration of this time delay may be in the order of only a few milliseconds, however as short as this might be it is critical that such a delay be present if the increment of feed movement is to be accurately maintained. After the slide 14 has completed its stock feed stroke and is to be moved through a non-feed stroke the fluid lines 221, 217 and the flexible line 37 will also be exhausted through said valve module 26 as above described. When the slide 14 moves away from wall 255 in a non-feed direction the spring 253 will cause plunger to move again to its extended position whereby spring 253 will axially expand with the result that its axial force on the valve member 230 will be reduced so that when pressure fluid is again supplied from the valve module 26 and through the flexible line 37 to the gripper motor 20 the fluid pressure in line 221 and bore 222 can readily shift the valve member 230 leftwardly to its FIG. 17 position against the now relatively low effective force of said time delay spring 253 thereon.

The feed slide 15 and its stock gripping means 17 operate in a manner similar to that just described for slide 14 and its gripping means 16; said slides functioning in substantially 180 degree phase relation with one another so as to alternately advance the stock to be fed, and very shortly after the completion of each such feed stroke of the slides 14 and 15 the stock will be released to allow any die pilot pins to finally position the stock relative to the die being used in the punch press with which the present feeder is associated. It will be noted that the auxiliary valve member 230 controls only the exhausting of the gripper motor 20 while only the primary or rotary valve means controls the initiation of the flow of pressure fluid to the gripper motor 20.

As and when the two auxiliary valves are used on slides 14 and 15 there may be short intervals of time when the stock is completely free of all gripping actions in which case it is desirable to have a means to positionally stabilize said stock during these intervals. To this end a very light constant frictional drag force is applied to the stock by a pair of similar yieldable clamping means 265 and 266 illustrated in FIGS. 1 and 13. Here a flanged tubular post 270 and a hardened wear washer 271 are adjustably clamped to the top surface of the end block 12 of the main frame by means of a screw 272 that threadedly engages a square nut 273 disposed in the T-slot 274 formed in said end block portion 12. Axially slidably mounted on post 270 is a clamping collar 275 that is biased downwardly by a spring 276 so as to cause said collar to continuously lightly clamp the stock S against the washer 271. In practice when so clamping the stock the collar 275 will actually assume a slightly tilted position as indicated by the collar axis line 277 of FIG. 13 whereby only the longitudinal side edges of the stock will be clamped and thus the remaining stock surfaces will not be marred or scratched by the continuous frictional drag force yieldably applied by collar 275.

The above described apparatus has been found to be capable of rapidly intermittently feeding strip stock and to afford the above noted advantages of compactness, flexibilityand accuracy.

I claim:

1. A pneumatically operated duplex stock feeder for intermittently advancing stock into the work station of a punch press or the like having a reciprocating ram: comprising a main frame;

a pair of alternately acting feed slides reciprocally carried by said main frame;

main fluid motor means carried by said frame for actuating said feed slides;

stock gripping means mounted on each of said feed slides;

gripper fluid motor means carried by said feed slides for actuating said stock gripping means;

a rotary valve means for controlling the operation of both said main and gripper fluid motor means; said rotary valve means including a valve block and a cooperating rotary valve member that is rotatably mounted in said valve block, said valve member being operative in successive predetermined discrete angular positions thereof to control the sequence of actuation of said fluid motor means;

a control member adapted to be shifted between first and second operative positions by the movement of the ram of said punch press; and stepper means actuated by the shifting of said control member for intermittently indexing said valve member to, and stopping said valve member at, said successive predetermined discrete angular positions thereof whereby said feed slides may alternately partake of a rapid succession of feed strokes.

2. Apparatus as defined by claim 1 additionally comprising a means for yieldably actuating said control member.

3. Apparatus as defined by claim 1 wherein said stepper means includes a one-way rotary drive means and wherein said control member includes a reciprocable control plunger for operating said drive means.

4. Apparatus as defined by claim 3 wherein said one-way drive means comprises a ratchet mechanism; and additionally comprising means for yieldably actuating said plunger in that direction which serves to actuate said ratchet mechanism and angularly displace said valve member.

5. Apparatus as defined by claim 1 wherein the long dimensions of said feed slides are each oriented so as to be substantially parallel to the longitudinal axis of said feeder.

6. Apparatus as defined by claim 1: additionally comprising means for coupling said main fluid motor means to said feed slides so that at least one of said feed slides may be laterally adjusted relative to said main fluid motor means.

7. Apparatus as defined by claim 1: additionally comprising auxiliary valve means associated with each of said gripper fluid motor means carried by said feed slides for controlling only the exhausting of pressure fluid from said gripper fluid motor means; and actuating means for said auxiliary valve means whereby the latter may be effectively operated just after completion of said feed strokes of said feed slides.

8. Apparatus as defined by claim 7 wherein each of said actuating means includes a sensing plunger that is adapted to be operated starting at a time just prior to the completion of the feed stroke of the associated feed slide, and means coupling said sensing plunger and the associated auxiliary valve means so that the latter may be operated just after completion of said feed stroke.

9. Apparatus as defined by claim 7: additionally comprising a continuously acting braking means for continuously applying a light frictional drag force to the longitudinal side edge portion only of the stock being moved through said feeder.

10. Apparatus as defined by claim 1 wherein said main frame includes a generally rectangular U-shaped frame having a main body portion, an end block portion and a plate-like portion interconnecting the lower regions of said main body and end block portions, and wherein said feed slides are reciprocally mounted on said interconnecting plate-like portion.

11. Apparatus as defined by claim 1: additionally comprising guide rails mounted on said main frame and adapted to be slidably engaged by the said feed slides and to constrain the motion of said feed slides to rectilinear movement, at least one of said guide rails being laterally adjustably mounted on and relative to said main frame so that the axis of the rectilinear path of movement of the associated feed slide may be laterally adjusted to selected positions varying in distance from the longitudinal axis of said feeder.

12. A duplex pneumatic feeder for intermittently advancing stock into the work station of a punch press or the like: comprising a main frame;

a pair of alternately acting feed slides reciprocally carried by said main frame;

stock gripping means carried by each of said feed slides;

gripper fluid motor means carried by each of said feed slides for respectively actuating said stock gripping means;

a pair of main fluid motor means for respectively actuating said feed slides and each including a piston and a piston rod;

valve means for controlling the operation of said main and gripper fluid motor means;

feed slide guide means carried by said main frame and cooperating with said feed slides so as to constrain the motion of the latter to rectilinear movement on said frame, said guide means being arranged to permit the axes of the rectilinear paths of movement of said feed slides to be laterally shifted relative to the axis of said feeder; and coupling means disposed between the outer end of the piston rod of each main fluid motor means and its respectively associated feed slide for permitting said lateral shifting of the said path of movement of each of said feed slides relative to the axis of its associated piston rod.

13. Apparatus as defined by claim 12 wherein the long dimensions of said feed slides are substantially parallel to the longitudinal axis of said feeder, and wherein said main frame includes a plate-like intermediate portion having flat upper surfaces on which said feed slides are reciprocally mounted.

14. Apparatus as defined by claim 12: additionally comprising auxiliary valve means associated with said fluid motor means carried by said feed slides for controlling the release of said gripping means;

sensing means adapted to be operated just prior to the completion of the feed strokes of said feed slides; and means coupling said sensing means to said auxiliary valve means so that the latter may be operated just after completion of said feed strokes whereby said stock is released shortly after completion of each of said feed strokes.

15. Apparatus as defined by claim 12 wherein said pair of main fluid motor means comprises two double-acting fluid motors, and wherein said double-acting fluid motors are each adapted to have fluid pressure continuously bias said feed slides for movement in a stock feeding direction.

16. Apparatus as defined by claim 12 wherein said valve means includes a rotary valve member that is rotatably mounted in a valve block carried by said main body portion of said frame, the axis of said valve member and block being disposed transverse with respect to the longitudinal axis of said feeder.

17. Apparatus as defined by claim 12 wherein said valve means includes a primary valve means that is capable of supplying and exhausting pressure fluid to and from said gripper fluid motors; and additionally comprising auxiliary valve means carried by said feed slides for controlling just an exhausting of pressure fluid from said gripper fluid motors.

18. In a pneumatically operated stock feeder for intermittently advancing stock into the work station of a punch press or the like and having a frame;

feed slide means reciprocally mounted on said frame;

stock gripping means carried by said feed slide means;

gripper fluid motor means for actuating said stock gripping means;

main fluid motor means for actuating said feed slide means; and primary valve means adapted to supply and exhaust pressure fluid to and from each of said fluid motor means so that said feed slide means may partake of a succession of feed strokes: the improvement comprising auxiliary valve means associated with said feed slide means for controlling only the release of said stock gripping means; and means for operating said auxiliary valve means to one operative condition thereof just after completion of a feed stroke of said feed slide means whereby said stock may be released by said stock gripping means, said auxiliary valve means being adapted to be moved to its other operative condition under the control of said primary valve means when the latter initiates the supply of pressure fluid to said gripper motor means prior to each feed stroke of said feed slide means.

19. Apparatus as defined by claim 18: wherein said means for operating said auxiliary valve means includes a sensing means adapted to be operated just prior to the completion of a feed stroke of said feed slide means; and coupling means controlled by said sensing means and adapted to operate said auxiliary valve means just after completion of said feed stroke of said feed slide means.

20. Apparatus as defined by claim 19 wherein said auxiliary valve means is carried by said feed slide means, wherein said sensing means includes a plunger that is also carried by said feed slide means and is displaced in response to and during the terminal portion of each feed stroke of said feed slide means, and wherein said coupling means includes an effective time delay means.

21. Apparatus as defined by claim 18 wherein said means for operating said auxiliary valve means includes a spring.

22. A duplex feeder for intermittently advancing stock into the work station of a punch press or the like having a reciprocating ram: comprising a main frame;

said main frame including a generally rectangular U-shaped frame unit having a main body portion, an end block portion, and an intermediate portion interconnecting said main body portion and said end block portion;

a pair of alternately acting feed slides carried by said intermediate frame portion for reciprocation in feed and non-feed directions;

stock gripping means carried by each of said feed slides;

a gripper fluid motor carried by each of said feed slides for respectively actuating said stock gripping means;

a pair of main double acting fluid motors carried by said main body portion for respectively actuating said feed slides;

fluid conduit means adapted to continuously supply pressure fluid to one end of both of said main fluid motors so as to cause said main fluid motors to continuously bias said feed slides for movement in a stock feed direction;

a rotary control valve means; said rotary valve means including a valve block and a rotatable valve member, said valve members being capable in predetermined successive discrete angular positions thereof of supplying and exhausting pressure fluid to and from said gripper fluid motors and to and from the other ends of said double acting main fluid motors;

a control member adapted to be shifted between first and second operative positions by the movement of the ram of said punch press; and a stepper mechanism actuated by the shifting of said control member for rotatably indexing said rotatable valve member to, and stopping said valve member at, said successive predetermined discrete angular positions of said rotatable valve member whereby said feed slides may alternately partake of a rapid succession of feed strokes.

23. Apparatus as defined by claim 22, additionally comprising auxiliary valve means carried by each of said feed slides, each auxiliary valve means being adapted to control only an exhausting of pressure fluid from its associated gripper motor, and only said rotatable valve member being adapted to initiate the flow of pressure fluid to said gripper motors; and operating means for actuating said auxiliary valve means.

24. Apparatus as defined by claim 23 wherein said operating means includes a sensing means adapted to be operated just prior to the completion of the feed strokes of said feed slides; and wherein said operating means actuates said auxiliary valve means just after completion of each of said feed strokes of said feed slides respectively.

25. Apparatus as defined by claim 22 wherein said main frame includes a pair of guide rails that respectively constrain said feed slides to rectilinear reciprocating movement, said rails extending over a portion of said slides respectively and being laterally adjustable on said frame and relative to the axes of said main double acting fluid motors

26. Apparatus as defined by claim 22 wherein said stepper mechanism includes a ratchet mechanism and wherein said control member comprises a plunger; and means for yieldably biasing said plunger in a direction of movement that serves to angularly index said rotatable valve member.

27. Apparatus as defined by claim 22 wherein said rotary valve means defines a separate unit module, and said stepper mechanism defines another separate unit module; said modules being disposed coextensive end to end relation so as to extend laterally over said main body portion of said main frame.

28. Apparatus as defined by claim 22 wherein said rotary valve member while in one of its said operative discrete angular positions being adapted to supply pressure fluid to the said other end of one of said main fluid motors while exhausting pressure fluid from the associated gripper fluid motor, and simultaneously exhausting pressure fluid from the other main fluid motor and supplying pressure to the latter's associated gripper fluid motor.

29. In a pneumatically operated stock feeder for intermittently advancing stock into the work station of a punch press or the like and having a frame;

feed slide means reciprocally mounted on said frame;

guide means for maintaining straight line reciprocating movement of said feed slide means;

main fluid motor means for reciprocally actuating said feed slide means;

stock gripping means carried by said feed slide means;

gripper fluid motor means for actuating said stock gripping means; and valve means for controlling the operation of said main and gripper fluid motor means so that said feed slide means may partake of a succession of feed strokes: the improvement comprising said frame including a main block portion, an end block portion and an intermedicate plate like portion interconnecting the lower regions of said main and end block frame portions, said feed slide means being mounted for reciprocation on the upper surface of said plate like frame portion;

said guide means comprising a rail bar means which extends between said main and end block portions of said frame and which overlies said feed slide means, the bottom of said rail means and the top of said feed slide means being fomed with a cooperating longitudinal groove and projection arrangement whereby said feed slide means is constrained to rectilinear movement on said plate like intermediate portion of said frame.

30. Apparatus as defined by claim 29 wherein said rail means is laterally adjustably mounted on said main and end block frame portions whereby the rectilinear reciprocating movement of said feed slide means may be selectively constrained to a desired one of a plurality of parallel paths.

* * * * *